US009315241B2

(12) United States Patent
Carrico et al.

(10) Patent No.: US 9,315,241 B2
(45) Date of Patent: Apr. 19, 2016

(54) BUOYANT TURRET MOORING WITH POROUS RECEPTOR CAGE

(71) Applicant: Seahorse Equipment Corp, Houston, TX (US)

(72) Inventors: Todd Vincent Carrico, Katy, TX (US); Steven John Leverette, Richmond, TX (US)

(73) Assignee: Seahorse Equipment Corp, Houston, TX (US)

( * ) Notice: Subject to any disclaimer, the term of this patent is extended or adjusted under 35 U.S.C. 154(b) by 35 days.

(21) Appl. No.: 14/268,866

(22) Filed: May 2, 2014

(65) Prior Publication Data

US 2015/0314835 A1 Nov. 5, 2015

(51) Int. Cl.

| | |
|---|---|
| ***B63B 21/50*** | (2006.01) |
| ***B63B 22/02*** | (2006.01) |
| ***B63B 21/00*** | (2006.01) |
| ***B63B 35/44*** | (2006.01) |
| *B63B 3/14* | (2006.01) |

(52) U.S. Cl.
CPC ..... *B63B 21/508* (2013.01); *B63B 35/4413* (2013.01); *B63B 2003/147* (2013.01)

(58) Field of Classification Search
CPC ..... B63B 21/508; B63B 34/4414; B63B 2003/147
See application file for complete search history.

(56) References Cited

U.S. PATENT DOCUMENTS

| | | | | |
|---|---|---|---|---|
| 6,155,193 | A | 12/2000 | Syvertsen et al. | |
| 6,543,376 | B1 * | 4/2003 | Breivik et al. | 114/230.12 |
| 8,118,632 | B2 * | 2/2012 | De Baan et al. | 441/4 |
| 2012/0012044 | A1 | 1/2012 | Lavagna et al. | |

FOREIGN PATENT DOCUMENTS

| | | | |
|---|---|---|---|
| EP | 2500257 | A1 | 9/2012 |
| WO | 2012032163 | A1 | 3/2012 |

* cited by examiner

*Primary Examiner* — Anthony Wiest
(74) *Attorney, Agent, or Firm* — Blank Rome LLP

(57) ABSTRACT

A disconnectable buoyant turret mooring system for an FPSO is vulnerable to damage from collisions between the buoy and the buoy turret cage during mating and de-mating operations. It is therefore desirable that the buoy separate quickly from the turret of the FPSO vessel during a disconnect operation. A buoy turret cage is provided with a certain degree of porosity that allows a flow of seawater from the outside of the receptor to the inner surface of the receptor. Introducing water in this way relieves the suction forces and allows for a quicker separation of the buoy from the turret of the FPSO vessel, minimizing the time during which an uncontrolled collision between the buoy and the FPSO vessel is most likely. Filling a portion of the turret above the mooring buoy with water prior to releasing the buoy also decreases the separation time.

21 Claims, 6 Drawing Sheets

BUOYANT TURRET MOORING WITH POROUS RECEPTOR CAGE

CROSS-REFERENCE TO RELATED APPLICATIONS

None

STATEMENT REGARDING FEDERALLY SPONSORED RESEARCH OR DEVELOPMENT

Not Applicable

BACKGROUND OF THE INVENTION

1. Field of the Invention

The present invention generally relates to offshore vessels used for the production of petroleum products. More specifically, it relates to a buoyant turret mooring system for a Floating Production, Storage and Offloading (FPSO) system.

2. Description of the Related Art Including Information Disclosed Under 37 CFR 1.97 and 1.98

A Floating Production Storage and Offloading system (FPSO) is a floating facility installed above or close to an offshore oil and/or gas field to receive, process, store and export hydrocarbons.

It consists of a floater, which may be either a purpose-built vessel or a converted tanker, that is moored at a selected site. The cargo capacity of the vessel is used as buffer storage for the oil produced. The process facilities (topsides) and accommodation are installed on the floater. The mooring configuration may be of the spread mooring type or a single point mooring system, generally a turret.

The high pressure mixture of produced fluids is delivered to the process facilities mounted on the deck of the tanker, where the oil, gas and water are separated. The water is discharged overboard after treatment to eliminate hydrocarbons. The stabilized crude oil is stored in the cargo tanks and subsequently transferred into shuttle tankers either via a buoy or by laying side by side or in tandem to the FPSO vessel.

The gas can be used for enhancing the liquid production through gas lift, and for energy production onboard the vessel. The remainder can be compressed and transported by pipeline to shore or reinjected into the reservoir.

Typically, offshore systems are designed to withstand the "100 year storm"—i.e. the most extreme storm that may statistically be expected to happen once every hundred years at the location where the system is installed. All locations have different hundred year storm conditions, with the worst storms being in the North Atlantic and the northern North Sea. Exceptionally bad storm conditions can occur in typhoon (hurricane) infested areas. Thus, some FPSO mooring systems are designed to be disconnectable, so that the FPSO vessel can temporarily move out of the storm path, and the mooring system need only be designed for moderate conditions.

A Buoyant Turret Mooring (BTM) system utilizes a mooring buoy that is fixed to the seabed by catenary anchor legs and supports crude oil and gas risers—steel or flexible pipe which transfer well fluids from the seabed to the surface. The BTM buoy may be connected by means of a structural connector to to an integrated turret. The earth-fixed turret extends up through a moonpool in the tanker, supported on a bearing and contains the reconnection winch, flow lines, control manifolds and fluid swivels located above the main deck. The bearings allow the vessel to freely rotate or weathervane in accordance with the prevailing environmental conditions.

The BTM system was developed for areas where typhoons, hurricanes or icebergs pose a danger to the FPSO vessel and, primarily for safety reasons, rapid disconnection and/or reconnection is required. Disconnection and reconnection operations may be carried out from the tanker without external intervention. When disconnected, the mooring buoy sinks to equilibrium depth and the FPSO vessel sails away.

A Steel Catenary Riser (SCR) is a steel pipe hung in a catenary configuration from a floating vessel in deep water to transmit flow to or from the seafloor.

A swivel stack is an arrangement of several individual swivels stacked on top of each other to allow the continuous transfer on a weathervaning FPSO vessel of fluids, gasses, controls and power between the risers and the process facilities on the FPSO vessel deck.

The turret mooring and high pressure swivel stack are thus the essential components of an FPSO vessel.

A heave compensation system is a mechanical system used to suppress the movements of a load being lifted, in an offshore environment, a mechanical system, often referred to as 'heave compensation system', is devised to dampen and control vertical movements. Two methods of heave compensation exist: passive systems and active systems.

U.S. Pat. No. 6,155,193 to Syvertsen et al. describes a vessel for use in the production and/or storage of hydrocarbons, including a receiving device having a downwardly open space for receiving and releasably securing a submerged buoy connected to at least one riser, a rotatable connector for connection with the buoy and transfer of fluids, and a dynamic positioning system for keeping the vessel at a desired position. The vessel includes a moonpool extending through the hull, and the receiving device is a unit which is arranged in the moonpool for raising and lowering, the rotatable connector being arranged at deck level, for connection to the buoy when the receiving unit with the buoy has been raised to an upper position in the moonpool. The moonpool is provided with a plurality of quite large holes all along its length and no holes are present in the receiving unit. The presence of the large holes, however, may jeopardize the structural integrity of the moonpool.

BRIEF SUMMARY OF THE INVENTION

A disconnectable BTM system is vulnerable to damage from collisions between the buoy and the buoy turret cage during reconnection and deconnection operations. The risk of collision may increase when the FPSO vessel and the buoy have differing heave periods. It is therefore desirable that the buoy separate quickly from the turret of the FPSO vessel during a disconnect operation. This minimizes the time period during which the two floaters are uncoupled from one another yet in close proximity to each other.

It has been found that the disconnect time is influenced by the behavior of the layer of water between the inner surface of the receptor and the outer surface of the buoy. Separating the two floaters requires that the suction produced by this layer of water as the two surfaces separate be overcome. This problem is particularly acute for BTM systems having very large buoys—i.e., systems wherein the buoys and receptors have a large mating surface area.

The present invention solves this problem by providing the turret cage with a certain degree of porosity that allows a flow of seawater from the outside of the receptor to the inner surface of the receptor. Introducing water in this way relieves the suction and/or stiction forces and allows for a quicker separation of the buoy from the turret of the FPSO vessel, minimizing the time during which an uncontrolled collision between the buoy and the FPSO vessel is most likely. Moreover, the hydrodynamic coupling created by a mostly closed turret cage may act to prevent uncontrolled collisions between the buoy and the turret of the FPSO vessel during connection (or re-connection) operations. Preferably, no porosity is present in the turret above the area where the lower end of the turret and the turret cage are connected, such that no outflow of seawater is allowed in this part. This permits the creation of a water column at the top end of the turret cage.

BRIEF DESCRIPTION OF THE SEVERAL VIEWS OF THE DRAWING(S)

DETAILED DESCRIPTION OF THE INVENTION

The invention relates to the use of porosity to optimize the connection and disconnection of a submersible mooring buoy to/from an FPSO vessel. A submersible buoy supports one or more risers, and is moored to the seafloor. The buoy is rigidly connected internal to the FPSO vessel under operational conditions; the buoy's mooring system provides the station keeping for the FPSO vessel. The buoy can be disconnected from the FPSO vessel, e.g. because of large sea states or storms.

The upper part of the buoy has a cone shape which mates with a cage-shaped structure attached internally to the FPSO vessel. Cage porosities ranging between 5% and 20% yield good synchronization of buoy and FPSO vessel motion during reconnect which then reduce impact velocities while achieving an acceptable short time frame for when the released buoy clears the FPSO vessel. Charging the space above the buoy with water (filling the turret before release) improves the disconnect time.

A buoyant turret mooring buoy supports one or more risers, and is moored to the seafloor. The buoy is rigidly connected to the FPSO's turret which is located inside a moonpool. Under operational conditions; the buoy's mooring system provides the station keeping for the FPSO vessel.

The main objective for the disconnect operation is to have the buoy separate quickly from the FPSO vessel thereby reducing the probability of collision. This nominally requires minimal hydrodynamic coupling between the buoy and turret. For reconnection, the objective is to minimize motion between the bodies thus enabling a more gentle connection. This nominally requires maximum hydrodynamic coupling between the buoy and turret. In practice, satisfying these objectives requires a blended design solution which balances their opposing needs. Typically, a more open walled turret cage facilitates rapid disconnect while a more closed cage provides better coupling during reconnection. The invention relates to the use of porosity (openings through the turret cage wall) as a critical design element in the overall buoy/turret system configuration. Other important design features include internal drain holes in the turret and a buoy heave compensation system.

Figure 1:
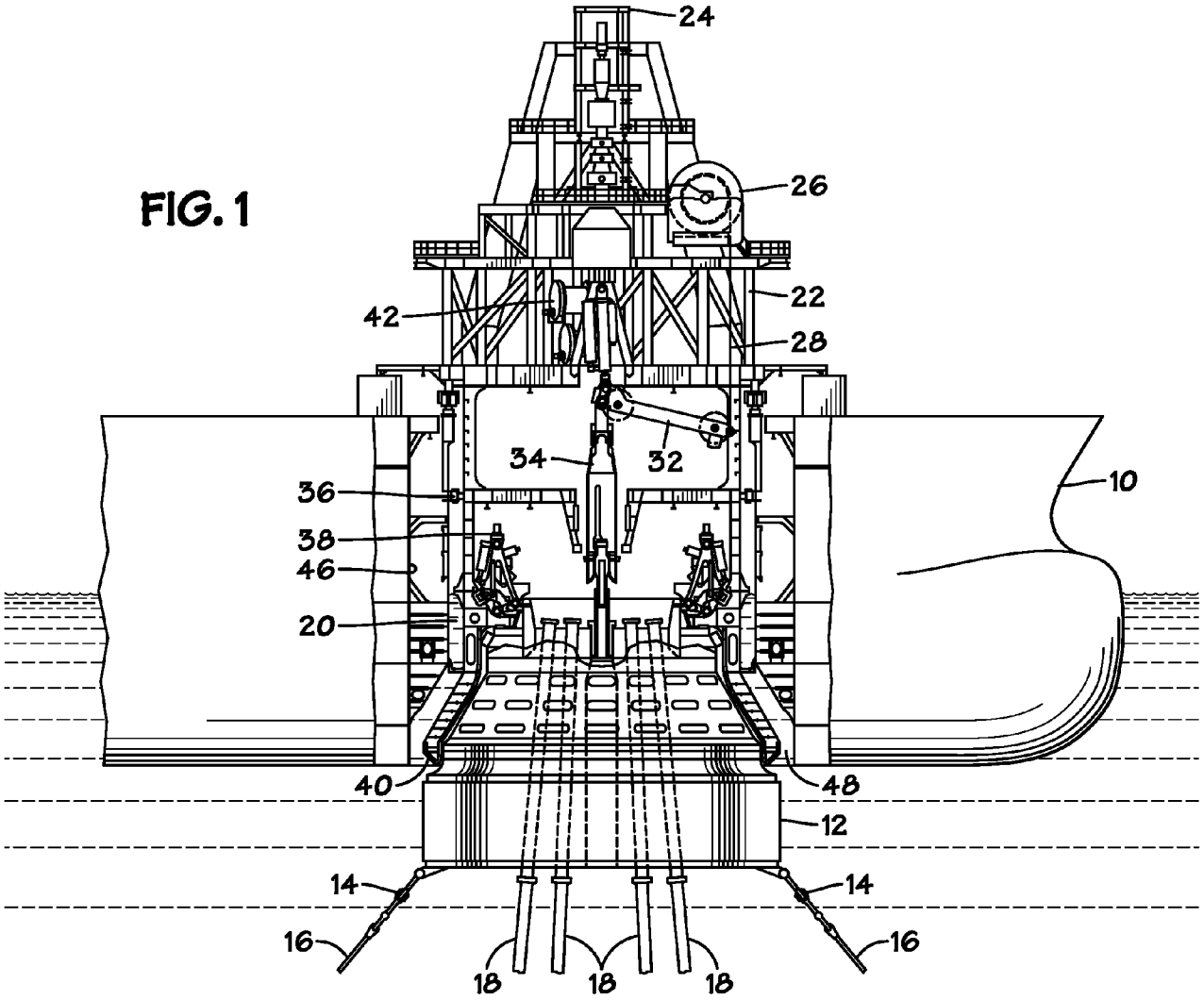
FIG. 1 is a side cut-away view of the bow portion of an FPSO vessel equipped with a buoyant turret mooring (BTM) system according to one embodiment of the invention.

Porosities ranging between 5% and 20% produce optimum hydrodynamic coupling between the buoy and FPSO vessel during reconnection which result in reduced impact velocities. These small porosity values have also been found to be acceptable for disconnection, for example when combined with prefilling the turret to about two meters above the FPSO vessel's mean waterline. The presence of an additional water column in the turret (up to about 2 meters above draft level) on top of the connected buoy may facilitate a quicker disengagement of the buoy from the turret when it needs to be disconnected. FIG. 1 shows the configuration prior to disconnect. In certain preferred embodiments, all water discharge openings in the turret are below the mating point of the buoy and the turret—i.e., seal 70 in FIG. 5.

Figure 7:
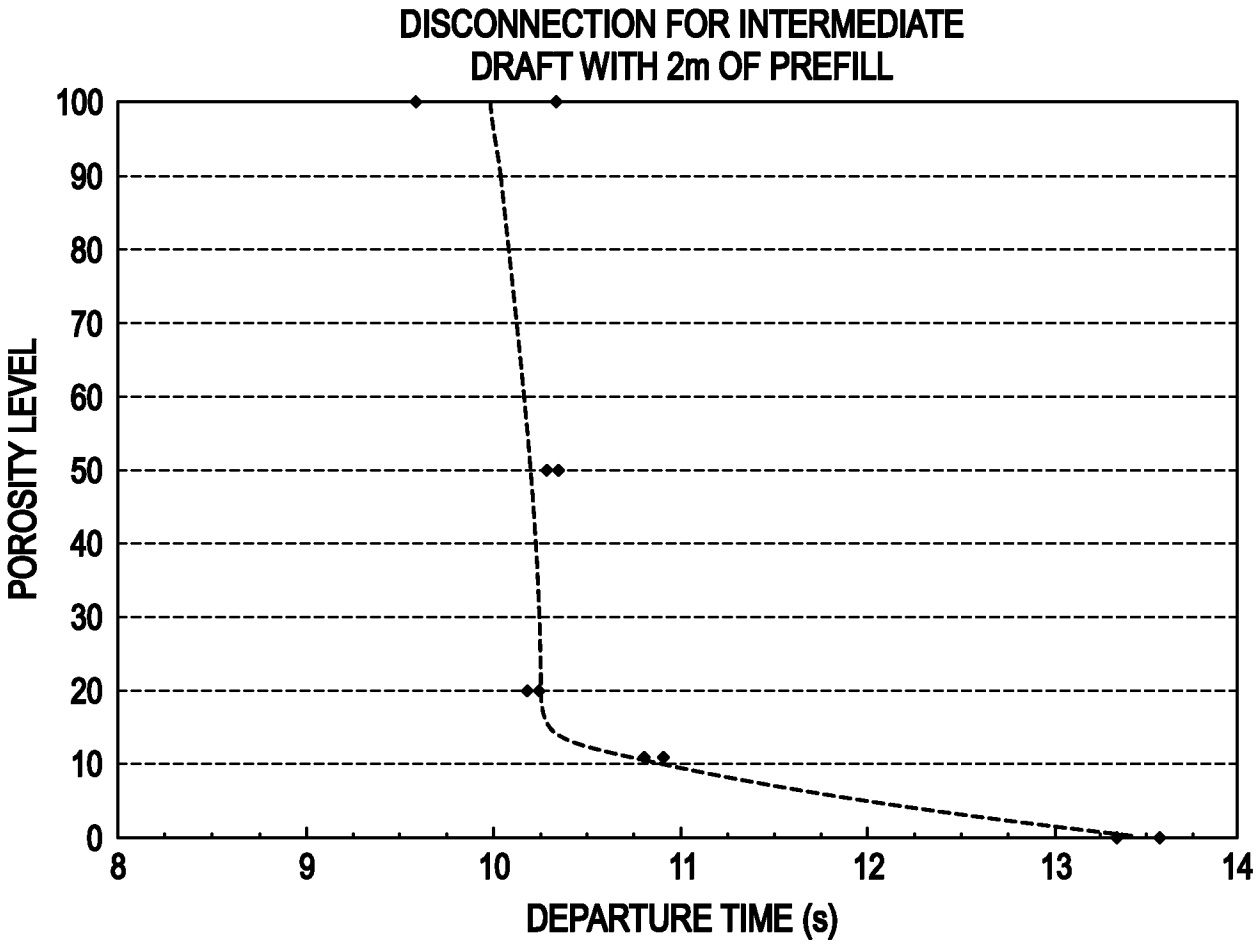
FIG. 7 is a graph showing buoy disconnect times for various porosity levels of a turret cage according to the invention.

The advantage that the porosity range provides is an acceptable balance that results in good disconnect and reconnect performance. Measured departure times from model tests are shown in FIG. 7. The data in FIG. 7 demonstrates that porosities greater than 20% all have approximately identical departure times. This indicates that the suction forces which try to keep the bodies together can be overcome with minimal porosity and a prefill charge of water. By allowing water to flow though a fraction of the cage wall, the newly created void left by the buoy's departure is rapidly filled. In addition, the net downward force acting on the buoy is temporarily increased by the weight of the additional volume of water.

This design feature is needed when developing buoys of extreme size. The porosity is one of the technologies that make connecting and disconnecting a BTM buoy of extreme size feasible. Prefilling the turret with water above the mean waterline prior to disconnect is an optional, supporting procedure.

The invention may best be understood by reference to the exemplary embodiment(s) illustrated in the drawing figures wherein the following reference numbers are used:

10 FPSO vessel hull
12 buoy
14 mooring line connector
16 mooring line
18 steel catenary riser (SCR)
20 moonpool
22 turret
24 swivel stack
26 pull-in winch
28 pull-in line
30 heave compensator
32 heave compensator pivot arm
34 bell housing
36 turret bearing
38 structural connector
40 turret cage
42 abandonment winch
44 stinger
46 moonpool wall
48 water gap
50 inner surface of receptor
52 prefill waterline
54 bumper
56 conical section of buoy
58 latching ring
62 radial opening
64 elongated annular opening

66 axial opening
68 porosity opening
70 buoy-to-turret seal

A detailed description of one or more embodiments of the buoy and receptor as well as methods for its use are presented herein by way of exemplification and not limitation with reference to the drawing figures.

Referring now to FIG. 1, FPSO vessel 10 is equipped with moonpool 20 containing turret 22 which connects to BTM buoy 12 secured by a plurality of structural connectors 38 arranged in an annular array.

BTM buoy 12 supports a plurality of steel catenary risers 18 at their upper end. Mooring lines 16 which extend to anchoring means in the seafloor (not shown) connect to buoy 12 via connectors 14 which, in the illustrated embodiment, are pivoting connectors. Thus, when connected, FPSO vessel 10 is releasably moored at the geo-location of buoy 12 while being free to weathervane about buoy 12 on bearings 36 in response to metocean conditions.

FIG. 1 shows buoy 12 in the connected state. In the connection operation, FPSO vessel 10 is maneuvered over submerged buoy 12 and pull-in line 28 is extended from winch 26 until bell housing 34 is latched to stinger 44. Pull-in winch 26 is then used to raise buoy 12 into turret cage 40 of turret 22. Heave compensator 30 acting via pivoting arm 32 may be used to avoid snatch loads on pull-in line 28. As buoy 12 approaches turret cage 40, the heave motions of the two floaters become synchronized and buoy 12 can be raised to a level that allows structural connectors 38 to move into the latched position, securing FPSO vessel 10 to mooring buoy 12.

When mooring buoy 12 is secured within turret 22, fluid connections between risers 18 and on-board processing equipment may be made via swivel stack 24.

Figure 2:
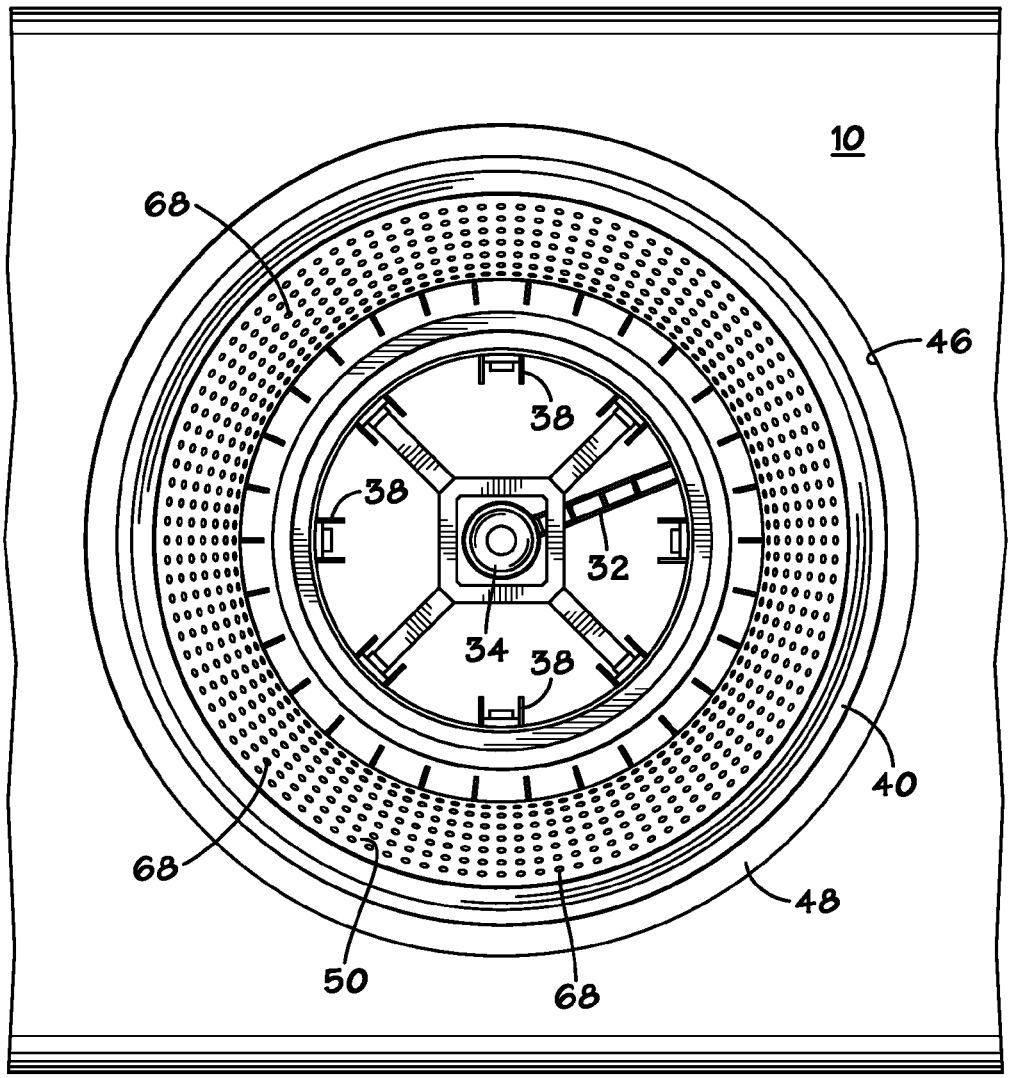
FIG. 2 is a bottom view of a BTM turret cage according to the invention.

FIG. 2 is a bottom view of the interior mating surface 50 of turret cage 40. An annular water gap separates the moonpool wall from turret cage 40. A plurality of porosity openings 68 exist as through holes in mating surface 50 of turret cage 40. It will be appreciated by those skilled in the art that, as the number and size of porosity openings 68 increases, the freedom of water flow through surface 50 increases but the structural strength of turret cage receptor 40 decreases. Thus, an appropriate balance between these competing design parameters must be established. As used herein, the percentage porosity of turret cage 40 is defined to be the sum total of the area of porosity openings 68 divided by the total area of the turret cage surface.

Figure 3:
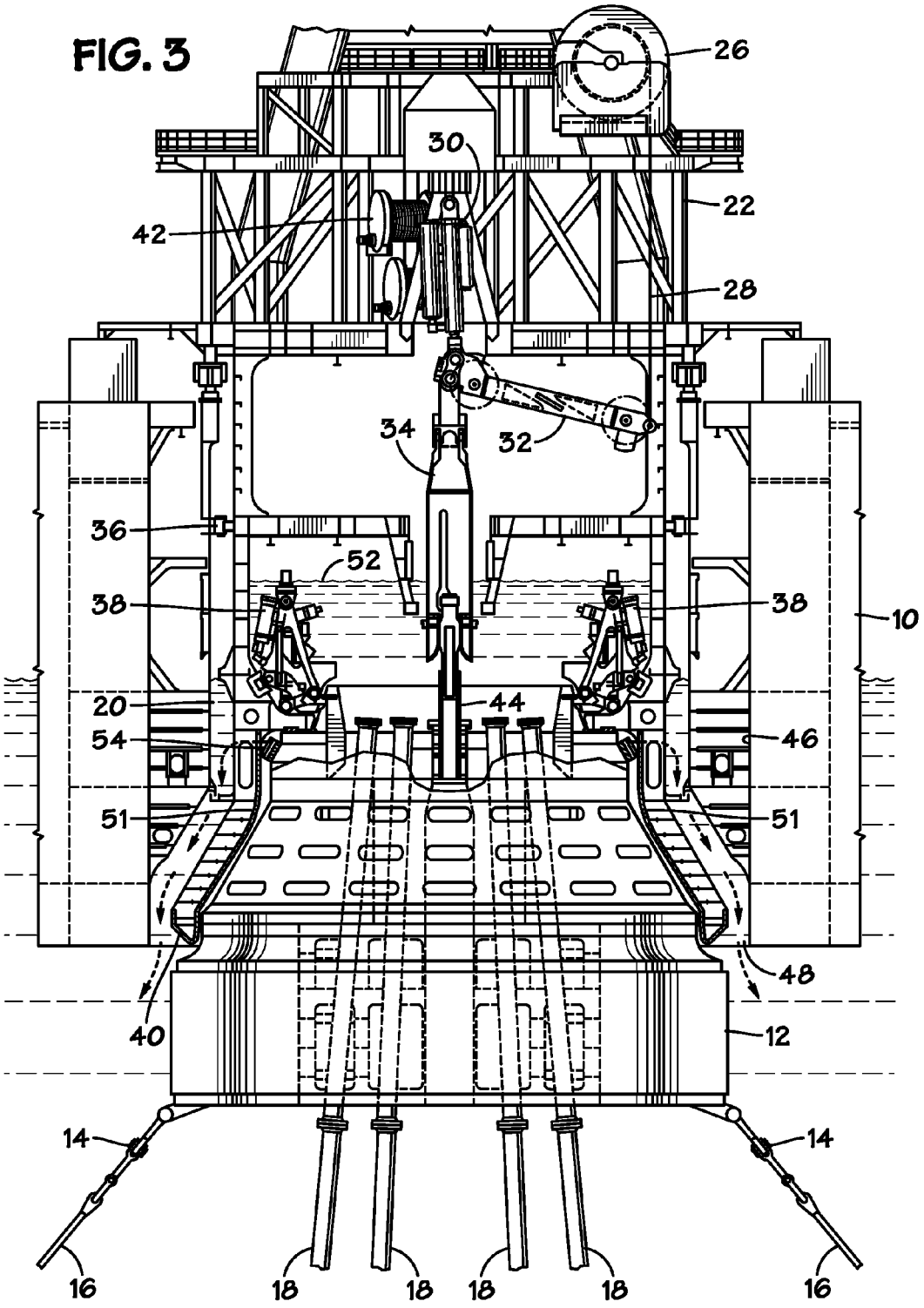
FIG. 3 is a side view, partially in cross section of a BTM buoy just prior to release from the turret of an FPSO vessel equipped with a turret cage according to the invention.
Figure 4:
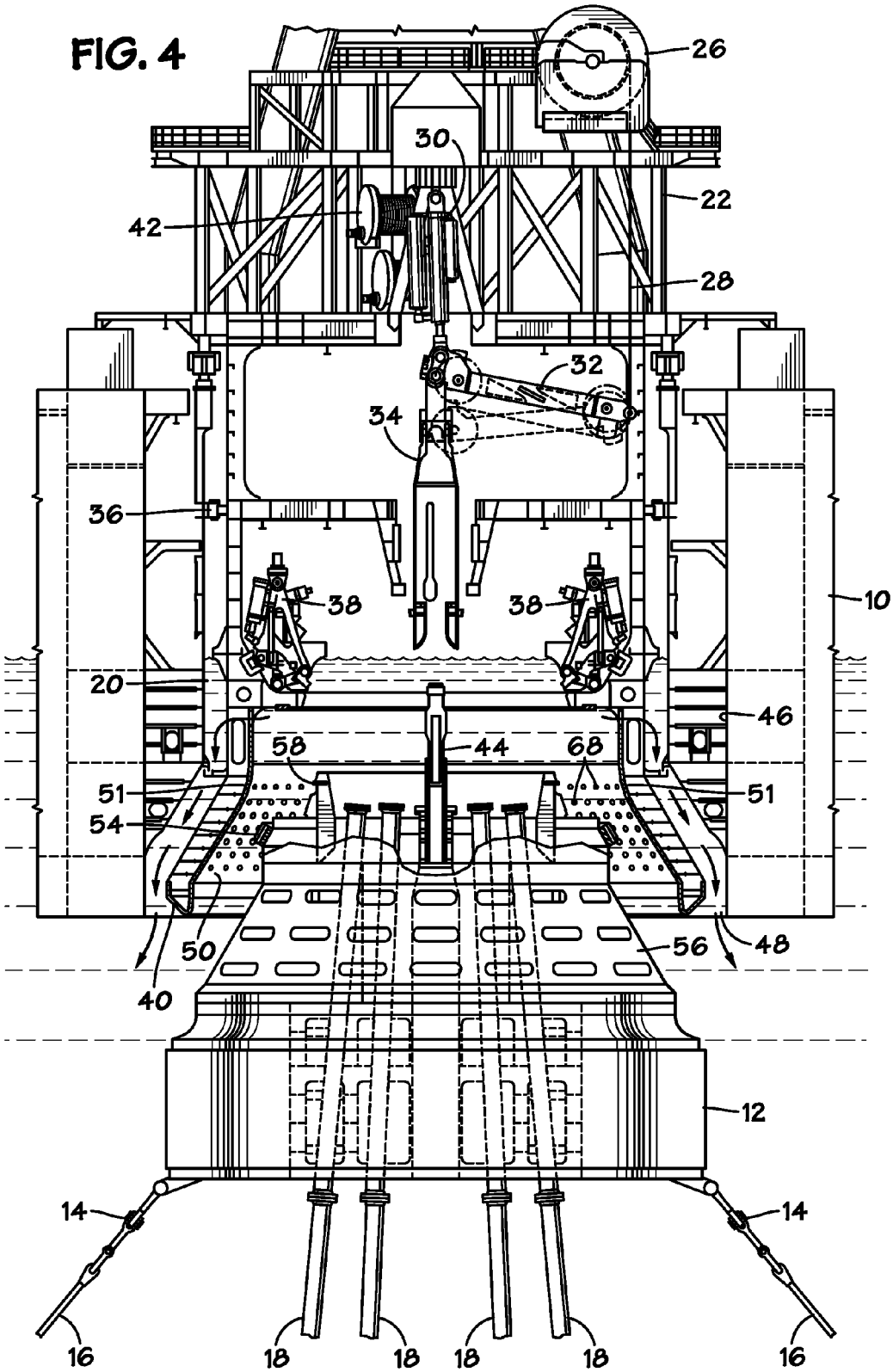
FIG. 4 is a side view, partially in cross section of a BTM buoy just subsequent to release from the turret of an FPSO vessel equipped with a turret cage according to the invention

A disconnect operation is shown sequentially in FIGS. 3 and 4. As may be seen in FIG. 3, the interior of turret 22 has been flooded to a level 52 (which may be approximately two meters above the mean waterline of the FPSO vessel) prior to buoy release. It has been found that the weight of this water on the upper surface of buoy 12 decreases the disconnect time.

FIG. 4 shows BTM buoy 12 a few seconds after being released from turret 12 by the retraction of structural connectors 38. Seawater may enter gap 48 and flow out porosity openings 68 to relieve the suction between surface 56 on buoy 12 and inner surface 50 of turret cage 40 as buoy 12 descends. Mooring lines 16 may connect to subsea spring buoys (not shown) and thus, as buoy 12 descends, the effective weight of the mooring system and risers 18 decreases until balanced by the buoyancy of buoy 12. Buoy 12 may, therefore, hover at a storm-safe distance below the surface during storms or ice encounters until the FPSO vessel returns and reconnects.

Figure 6:
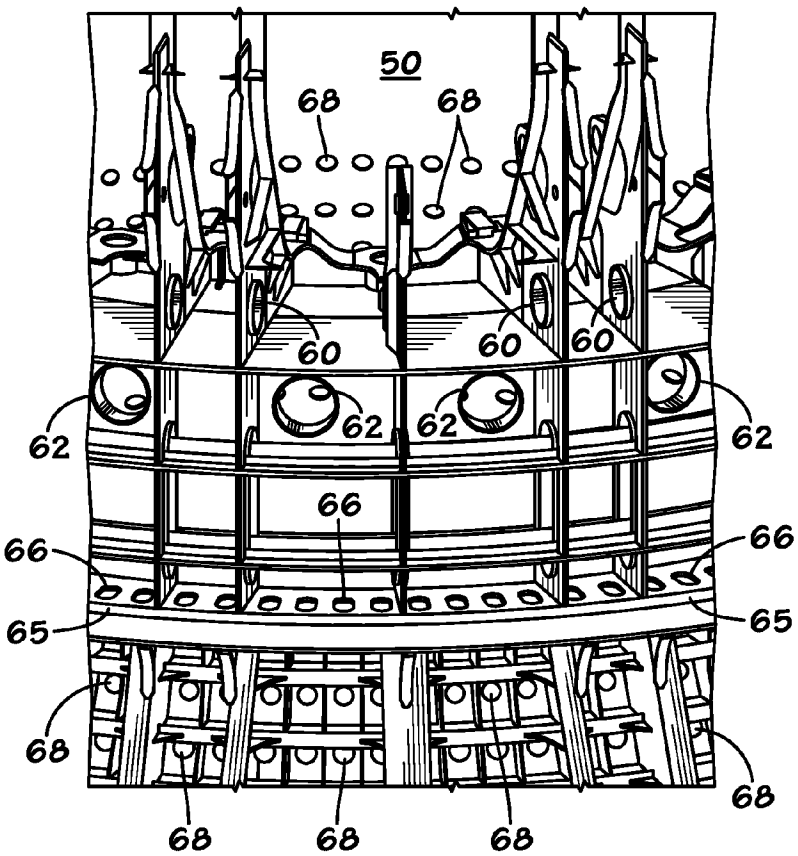
FIG. 6 is a three-dimensional illustration of a representative portion of a turret cage according to the invention.
Figure 5:
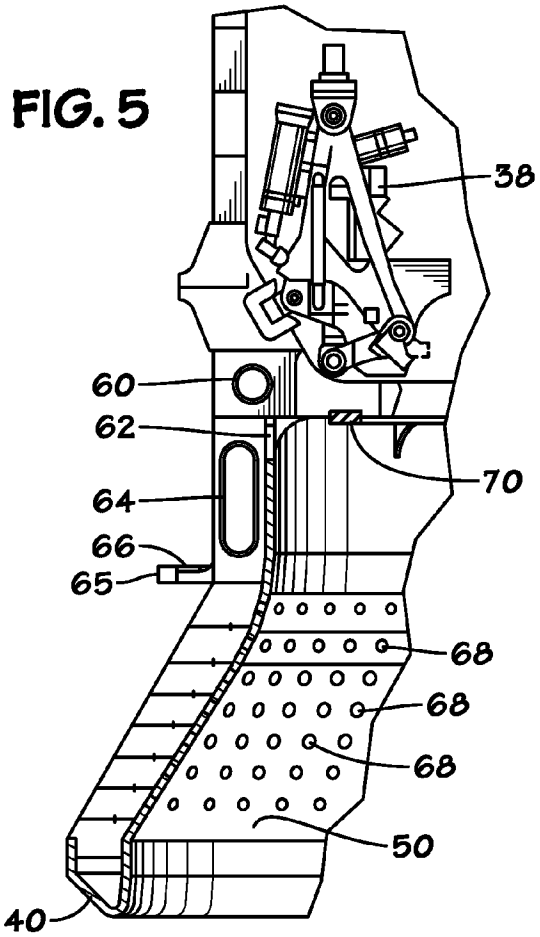
FIG. 5 is a partial, side, cross-sectional view of a turret cage according to the invention.

Structural details of one, particular, preferred embodiment of the invention are shown in FIGS. 5 and 6. A single structural connector 38 appears in FIG. 5 along with turret-to-buoy annular seal 70 which may be an inflatable seal that contacts an opposing flat surface on the upper portion of buoy 12.

Various structural ribs, plates and stiffeners are shown in the three-dimensional view of FIG. 6. An array of porosity openings 68 are provided in interior surface 50 of turret cage 40. In the illustrated embodiment, these porosity openings 68 are generally circular. However, other opening shapes may be used to achieve the results of the invention.

In addition to porosity openings 68, a series of radial openings 62, annular openings 64, and axial openings 66 are provided in selected structural members. These openings provide a water discharge path for seawater that would otherwise be trapped above buoy 12 when it is raised into turret 22. In general, this entrained seawater flows radially outward through openings 62 and then axially downward through openings 66 to discharge through gap 48 between moonpool wall 46 and turret cage 40. The additional openings may further contribute to improved reconnect and/or disconnect times.

As illustrated graphically in FIG. 7, experimental results obtained using scale models in a wave tank indicate that the buoy disconnect time does not decrease appreciably above a porosity level of about 20%. In this way, a porosity level may be selected which provides adequate strength of the receptor cage, a cushioning effect during connection operations, and an acceptably short disconnect time.

In certain, selected, representative embodiments, a turret cage according to the invention may comprise a generally bell-shaped structure having an open, top end and an opposing, open, bottom end and an inner surface between the top and bottom ends at least of portion of which is in the shape of a conical frustum; and, a plurality of through holes in the conical frustum portion of the inner surface. The generally bell-shaped structure may comprise a framework that is open on a first, outer side and is at least partially sheathed on a second, inner side. The portion in the shape of a conical frustum may be sheathed. The turret cage may further comprise a curved section 51 of the inner surface adjacent an upper end of the conical frustum portion and a plurality of through holes in the curved section. The turret cage may also further comprise an annular projection 65 on the outer side having a plurality of axial through holes therein. The turret cage may also further comprise a plurality of radial through holes in an upper, generally cylindrical portion of the inner surface proximate the top end. The plurality of radial through holes may be sized and spaced to permit water flowing up and out the open top end to drain over an outer side of the generally bell-shaped structure. The total area of the through holes may preferably be between about 5 percent to about 20 percent of the total area of the turret cage surface.

An FPSO vessel according to the invention may comprise a hull having a moonpool therein; a rotatable turret within the moonpool; a generally bell-shaped structure attached to a lower end of the turret and having an open, top end and an opposing, open, bottom end and an inner surface between the top and bottom ends at least of portion of which is in the shape of a conical frustum; and, a plurality of through holes in the conical frustum portion of the inner surface. The generally bell-shaped structure may comprise a framework that is open on a first, outer side and is at least partially sheathed on a second, inner side. The portion in the shape of a conical frustum may be sheathed. The turret cage may further comprise a curved section 51 of the inner surface adjacent an upper end of the conical frustum portion and a plurality of through holes in the curved section. The turret cage may also further comprise an annular projection 65 on the outer side having a plurality of axial through holes therein. The turret cage may also further comprise a plurality of radial through holes in an upper, generally cylindrical portion of the inner surface proximate the top end. The plurality of radial through holes may be sized and spaced to permit water flowing up and out the open top end to drain over an outer side of the generally bell-shaped structure. The total area of the through holes may preferably be between about 5 percent to about 20 percent of the total area of the turret cage surface.

A method according to the invention for disconnecting a mooring buoy from an FPSO vessel equipped with a buoyant turret mooring system may comprise providing a turret cage within a moonpool on the FPSO vessel said receptor having an inner surface that is at least partially sheathed with sheathing having a plurality of through holes; and, releasing the mooring buoy from the turret cage. The plurality of through holes in the sheathing preferably has a sum total area that is between about 5 percent and about 20 percent of the total area of the turret cage inner surface. The method may further comprise filling at least a portion of the moonpool above an upper surface of a mooring buoy secured within the turret cage with water prior to releasing the mooring buoy.

A cylindrical turret according to the invention for an FPSO vessel may have a turret at its lower end provided with a generally bell shaped structure attached to a lower end of the turret and having an open, top end and an opposing, open, bottom end and an inner surface between the top and bottom ends at least of portion of which is in the shape of a conical frustum, a plurality of through holes in the conical frustum portion of the inner surface and wherein no porosity is present in the lower turret wall in the area above the generally bell shaped structure.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. A turret cage for an FPSO vessel equipped with a buoyant turret mooring system comprising:

a generally bell-shaped structure having an open, top end and an opposing, open, bottom end and an inner surface between the top and bottom ends at least of portion of which is in the shape of a conical frustum;

a plurality of through holes in the conical frustum portion of the inner surface.

2. The turret cage recited in claim 1 wherein the generally bell-shaped structure comprises a framework that is open on a first, outer side and is at least partially sheathed on a second, inner side.

3. The turret cage recited in claim 2 wherein the portion in the shape of a conical frustum is sheathed.

4. The turret cage recited in claim 2 further comprising an annular projection on the outer side having a plurality of axial through holes therein.

5. The turret cage recited in claim 1 further comprising a curved section of the inner surface adjacent an upper end of the conical frustum portion and a plurality of through holes in the curved section.

6. The turret cage recited in claim 1 further comprising a plurality of radial through holes in a upper, generally cylindrical portion of the inner surface proximate the top end.

7. The turret cage recited in claim 6 wherein the plurality of radial through holes are sized and spaced to permit water flowing up and out the open top end to drain over an outer side of the generally bell-shaped structure.

8. The turret cage recited in claim 1 wherein the total area of the through holes is between about 5 percent to about 20 percent of the total area of the turret cage surface.

9. An FPSO vessel comprising:

a hull having a moonpool therein;

a rotatable turret within the moonpool;

a generally bell-shaped structure attached to a lower end of the turret and having an open, top end and an opposing, open, bottom end and an inner surface between the top and bottom ends at least of portion of which is in the shape of a conical frustum; and, a plurality of through holes in the conical frustum portion of the inner surface.

10. The FPSO vessel recited in claim 9 wherein the generally bell-shaped structure comprises a framework that is open on a first, outer side and is at least partially sheathed on a second, inner side.

11. The FPSO vessel recited in claim 10 wherein the portion in the shape of a conical frustum is sheathed.

12. The FPSO vessel recited in claim 10 further comprising an annular projection on the outer side having a plurality of axial through holes therein.

13. The FPSO vessel recited in claim 9 further comprising a curved section of the inner surface adjacent an upper end of the conical frustum portion and a plurality of through holes in the curved section.

14. The FPSO vessel recited in claim 9 further comprising a plurality of radial through holes in a upper, generally cylindrical portion of the inner surface proximate the top end.

15. The FPSO vessel recited in claim 14 wherein the plurality of radial through holes are sized and spaced to permit water flowing up and out the open top end to drain over an outer side of the generally bell-shaped structure.

16. The FPSO vessel recited in claim 9 wherein the total area of the through holes is between about 5 percent to about 20 percent of the total area of the turret cage surface.

17. The FPSO vessel recited in claim 9 wherein the generally bell-shaped structure is sized to fit within the moonpool such that the bell-shaped structure is spaced apart from an inner wall of the moonpool.

18. A method of disconnecting a mooring buoy from an FPSO vessel equipped with a buoyant turret mooring system comprising:

providing a turret cage within a moonpool on the FPSO vessel said turret cage having an inner surface at least of portion of which is in the shape of a conical frustum and having a plurality of through holes in the conical frustum portion of the inner surface; and, releasing the mooring buoy from the turret cage.

19. The method recited in claim 18 wherein the plurality of through holes in the inner surface have a sum total area that is between about 5 percent and about 20 percent of the total area of the turret cage inner surface.

20. The method recited in claim 18 further comprising filling at least a portion of the moonpool above an upper surface of a mooring buoy secured within the turret cage with water prior to releasing the mooring buoy.

21. A cylindrical turret for a FPSO vessel wherein the turret at its lower end is provided with a generally bell shaped structure attached to a lower end of the turret and having an open, top end and an opposing, open, bottom end and an inner surface between the top and bottom ends at least of portion of which is in the shape of a conical frustum, a plurality of through holes in the conical frustum portion of the inner surface and wherein no porosity is present in a lower turret wall in an area above the generally bell shaped structure.

* * * * *